US011723132B2

(12) United States Patent
Hagemeier et al.

(10) Patent No.: US 11,723,132 B2
(45) Date of Patent: Aug. 8, 2023

(54) CONTROL AND/OR REGULATING SYSTEM, CIRCUIT ARRANGEMENT AND PROCEDURE FOR REDUCING THE MAXIMUM CURRENT IN AN LED (LIGHT-EMITTING DIODE) FIELD

(71) Applicant: Hella GmbH & Co. KGaA, Lippstadt (DE)

(72) Inventors: Bernd-Ulrich Hagemeier, Lippstadt (DE); Sarah Knoop, Salzkotten (DE); Carsten Wilks, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/593,038

(22) PCT Filed: Feb. 18, 2020

(86) PCT No.: PCT/EP2020/054229
§ 371 (c)(1),
(2) Date: Sep. 7, 2021

(87) PCT Pub. No.: WO2020/182428
PCT Pub. Date: Sep. 17, 2020

(65) Prior Publication Data

US 2022/0174797 A1 Jun. 2, 2022

(30) Foreign Application Priority Data

Mar. 8, 2019 (DE) ..... 10 2019 105 954.2

(51) Int. Cl.
*H05B 45/10* (2020.01)
*H05B 45/32* (2020.01)
*H05B 45/325* (2020.01)

(52) U.S. Cl.
CPC ..... *H05B 45/325* (2020.01)

(58) Field of Classification Search
CPC ..... H05B 45/00; H05B 45/10; H05B 45/30; H05B 45/32; H05B 45/325; H05B 45/52
See application file for complete search history.

(56) References Cited

U.S. PATENT DOCUMENTS 5,736,881 A * 4/1998 Ortiz ..... H05B 45/3725 327/515
8,854,293 B2 10/2014 Seong et al.
(Continued)

FOREIGN PATENT DOCUMENTS

DE 102007002809 A1 7/2008
DE 202012004747 U1 9/2012
(Continued)

*Primary Examiner* — Thai Pham
(74) *Attorney, Agent, or Firm* — Husch Blackwell LLP

(57) ABSTRACT

A control/regulating system is provided for controlling/regulating an LED field with n LEDs, where n>2, with outputs at which control/regulating signals for controlling/regulating controllable switching elements can be tapped. Activation/deactivation times $$\left(t_{ein_{jp_j}}, t_{aus_{jp_j}}\right)$$

of impulses can be defined by the control/regulating system through the control signals/regulating signals. One and/or several controllable switching elements can be actuated during the determined impulses for closing or opening. A number of k groups can be specified. Each LED is allocated to one of the k groups such that each of the k groups $m_j$ contains LEDs, where $1 \leq j \leq k$ and $\Sigma_{j=1}^{k} m_j = n$ apply, a reference time $\alpha_j = \alpha_1 \ldots \alpha_k$ can be determined for each group and the activation and deactivation time (Continued)

$$\left(t_{ein_{jp_j}}, t_{aus_{jp_j}}\right)$$

of the impulse for each LED of every group can be determined as a factor of the reference time $\alpha_j=\alpha_1 \ldots \alpha_k$, where $1 \leq p_j \leq m_j$ applies.

12 Claims, 5 Drawing Sheets

(56) References Cited

U.S. PATENT DOCUMENTS 9,839,083 B2 * 12/2017 van de Ven ..... H05B 45/20
2010/0001944 A1 * 1/2010 Seong ..... G09G 3/3648 345/102
2011/0031895 A1 * 2/2011 Liu ..... H05B 45/375 315/294
2012/0187762 A1 * 7/2012 Kim ..... H05B 45/46 307/32
2014/0111102 A1 * 4/2014 Angelin ..... H05B 45/375 315/186
2014/0306530 A1 * 10/2014 Theiler ..... H02M 3/1584 307/31
2021/0204376 A1 * 7/2021 Muehlschlegel ..... H05B 45/37

FOREIGN PATENT DOCUMENTS

EP 3383142 A1 10/2018
KR 1020140092184 A 7/2014
WO 2006107199 A2 10/2006

* cited by examiner

CONTROL AND/OR REGULATING SYSTEM, CIRCUIT ARRANGEMENT AND PROCEDURE FOR REDUCING THE MAXIMUM CURRENT IN AN LED (LIGHT-EMITTING DIODE) FIELD

CROSS REFERENCE

This application claims priority to PCT Application No. PCT/EP2020/054229, filed Feb. 18, 2020, which itself claims priority to German Application No. 10 2019 105954.2, filed Mar. 8, 2019, the entirety of both of which are hereby incorporated by reference.

FIELD OF THE INVENTION

The invention relates to a control and/or regulating system for controlling and/or regulating an LED field with n LEDs, where n>2 with outputs at which control and/or regulating signals for controlling and/or regulating controllable switching elements can be tapped, where activation times and/or deactivation times $$\left(t_{ein_{jp_j}}, t_{aus_{jp_j}}\right)$$

of impulses can be defined by means of the control and/or regulating system through the control signals and/or regulating signals and one and/or several controllable switching elements can be actuated during the determined impulses for closing or opening. A circuit arrangement and a procedure for operating the circuit arrangement.

BACKGROUND OF THE INVENTION

With LED fields, the luminance of each individual pixel is controlled through a pulse width modulated (current) signal with an impulse with a pulse width of PW=0-100%.

In the systems available today, it is usual for all LEDs of an LED field to be activated simultaneously at time $t_{ein}=0$ and then successively deactivated at the end of their impulse at time $$t_{aus_{jp_j}}.$$

This leads to a strong pulse current load in the supply to such an LED field, especially at the activation time $t_{ein}=0$. This, in turn, increases the demands placed on the supply to these systems and can lead to problems with the EMC.

Such an LED field can be found, for example, in newly developed LED headlamps with several tens of thousands of LEDs within an LED field. Here it is desirable to reduce the maximum level of current in the system and to even out the current curve overall in order to achieve better EMC conditions and to facilitate a more favorable design of the supply to the LEDs.

This is the point at which the present invention comes in.

BRIEF SUMMARY OF THE INVENTION

The task underlying the invention is to propose a control and/or regulating system, a circuit arrangement and a procedure by which the maximum current taken in by an LED field can be reduced.

In a first variant, this task is solved in accordance with the invention by a control and/or regulating system for controlling and/or regulating an LED field with n LEDs where n>2 with outputs at which control and/or regulating signals for controlling and/or regulating of controllable switching elements can be tapped, where the control and/or regulating system can be used to define activation times and/or deactivation times $$\left(t_{ein_{jp_j}}, t_{aus_{jp_j}}\right)$$

of impulses through the control signals and/or regulating signals and one and/or several controllable switching elements can be actuated during the determined impulses for closing or opening, where a number of k groups can be specified, each LED is allocated to one of the k groups such that each one of the k groups $m_j$ contains LEDs, where $1 \leq j \leq k$ and $\Sigma_{j=1}^{k} m_j = n$ apply, a reference time $\alpha_j = \alpha_1 \ldots \alpha_k$ can be determined for each group and the activation and the deactivation time $$\left(t_{ein_{jp_j}}, t_{aus_{jp_j}}\right)$$

of the impulse for each LED of every single group can be determined as a factor of the reference time $\alpha_j = \alpha_1 \ldots \alpha_k$, where $1 \leq p_j \leq m_j$ applies.

The grouping of the individual LEDs of an LED field into groups and the allocation of different reference times to determine the activation or deactivation times lead to a distribution of the impulses over a clock cycle. This measure reduces the maximum current in the system and flattens the current curve.

Required luminance distributions frequently feature minor gradients with regard to the luminance between neighboring LEDs, i.e., neighboring LEDs must have a similar luminance and thus feature a similar impulse. This is the case in particular with the application of an LED field in a headlamp and the target light distributions to be expected there.

To maximize the advantages of the proposed invention, it is consequently expedient for the allocation of each LED to one of the k groups to be performed in such a way that neighboring LEDs are allocated to different groups. The LEDs in a group should be distributed in such a manner that, within a group, no LED blocks of neighboring LEDs are formed.

The following shows, as an example, how an expedient allocation of the LEDs to the k groups can be performed. It is assumed that a matrix LED system is involved in which the LEDs are arranged in columns and rows. Other geometries can be easily arranged in a similar manner.

For k=2, the individual LEDs of an LED field should be allocated to the groups 1 and 2 as follows:

1 2 1 2 1 2 1 2 1 2 1 2 1 2 1 2 . . .
2 1 2 1 2 1 2 1 2 1 2 1 2 1 2 1 . . .
1 2 1 2 1 2 1 2 1 2 1 2 1 2 1 2 . . .

For k=3, the individual LEDs of an LED field could be allocated to the groups 1, 2 and 3 as follows:

1 2 3 1 2 3 1 2 3 1 2 3 1 2 3 . . .
2 3 1 2 3 1 2 3 1 2 3 1 2 3 1 . . .
3 1 2 3 1 2 3 1 2 3 1 2 3 1 2 . . .

For k=5, an expedient allocation of the individual LEDs of an LED field is, for example, as follows:

1 4 2 5 3 1 4 2 5 3 . . .
2 5 3 1 4 2 5 3 1 4 . . .
3 1 4 2 5 3 1 4 2 5 . . .
4 2 5 3 1 4 2 5 3 1 . . .

It can be advantageous for the reference time $\alpha_j=\alpha_1 \ldots \alpha_k$ to be selectable at random. This saves computing power within the control and/or regulating system.

The objective can, however, be to separate the activation times or the deactivation times as far as possible from each other as a reduction in the maximum current can be achieved by not all LEDs being activated at the same time or shortly after each other.

Advantageously, the reference time $\alpha_j=\alpha_1 \ldots \alpha_k$ can be determined as follows:

k=1: $\alpha_1$ can be chosen at will, k=2: $\alpha_1=0$, $\alpha_2=T$, $$k > 2:\ a_1 = 0,$$
$$a_2 \ldots a_{k-1} = i\frac{T}{k-1},$$
$$a_k = T$$

with i=1 . . . k−2, where T is a clock cycle.

From the determined reference times $\alpha_j=\alpha_1 \ldots \alpha_k$, it is possible to determine the activation time and the deactivation time of the impulse for each LED in a group.

One option is for the activation time $$\left(t_{ein_{jp_j}}\right)$$

of the impulse for each LED in a group to be calculated as a factor of a using the equation:

$$t_{ein_{jp_j}} = a_j - a_j * PW_{jp_j}$$

and the deactivation time $$\left(t_{aus_{jp_j}}\right)$$

of the impulse for each LED in a group can be calculated as a factor of a using the equation:

$$t_{aus_{jp_j}} = a_j + (T - a_j) * PW_{jp_j}$$

where $\alpha_j=\alpha_1 \ldots \alpha_k$ applies, $PW_{jp_j}$=pulse width of the p. LED in j. group in % of T applies.

The activation time and the deactivation time of the impulse for each LED in a group can be calculated for all desired implementation forms in accordance with the equations given.

$$a_j = 0 t_{einjp_j} = 0 - 0 * PW_{jp_j} = 0 t_{aus_{jp_j}} = 0 + (T - 0) * PW_{jp_j} = T * PW_{jp_j}$$

For the case mentioned at the beginning of this document where all LEDs are to be activated at the beginning of a clock cycle, this means a reference time of.

Inserting this value for a in the equations results in and. This means that all impulses are activated at the beginning of the clock cycle and deactivated again after the impulse duration of each LED.

$$a_j = 0 t_{einjp_j} = 0 - 0 * PW_{jp_j} = 0^{t_{aus_{jp_j}}} = 0 + (T - 0) * PW_{jp_j} = T * PW_{jp_j}$$

The same principle applies in the event that all LEDs are deactivated at the end of the clock cycle and the individual activation time has to be calculated for each impulse. In this case, the reference time $\alpha_j$=T has to be inserted in the equations. It is easy to see that this results in an individual activation time of the impulse for every LED and a mutual deactivation time at the end of the clock cycle.

For every reference time $\alpha_j$ lying within a clock cycle, the equations provide how long before the reference time each impulse is activated and how long after the reference time each impulse is deactivated. In this way, the equations given result in impulses being distributed as evenly as possible over a clock cycle.

As the number of k groups to be formed is limited by the technical possibilities, k should be chosen following the principle of "as large as necessary, as small as possible".

In a second variant, this task is solved as follows: the control and/or regulating system is able to calculate a mean value $M_{PW}$ of the pulse widths $PW_i$ in accordance with the equation $$M_{PW} = \frac{1}{n}\sum_{i=0}^{n} PW_i,$$

depending on the mean value $M_{PW}$, a number of k groups can be specified, in accordance with the equation $k=M_{PW}^{-1}$, every LED is allocated to one of the k groups.

In accordance with the invention, the control and/or regulating system can be set up in such a way that the results of simulations can be stored in order to determine the optimum number of k.

Then there is an option that the procedure for setting up the control and/or regulating system features at least the following steps: required luminance distributions that are to be achieved by means of the LED field are reproduced in a simulation, the impulses of the individual LEDs in a group for the required luminance distribution are determined on the basis of the simulation, a current distribution within the LED field is simulated on the basis of the impulses for different numbers of groups, an optimum number of k groups is determined on the basis of the current distributions, the data determined on the basis of the simulation are transferred to the control and/or regulating system.

Furthermore the invention relates to a circuit arrangement for controlling and/or regulating an LED field. The inventive circuit arrangement features a control and/or regulating system, a current source for each LED and an LED field, where the LED field features at least two series circuits each of which comprises at least one LED and a controllable switching element, where a control connection of each controllable switching element is connected with an output of the control and/or regulating system.

In this respect, one option is for each current source of the inventive circuit arrangement to be regulated by the control and/or regulating system, where the current with a closed controllable switching element is $i=i_{max}$ and with an opened controllable switching element is $i=0$.

The procedure for operating an inventive circuit arrangement features at least the following steps: a number of k groups are determined by the control and/or regulating system or transferred to the control and/or regulating system or determined at random, each LED is allocated to a group, a reference time $\alpha_j=\alpha_1 \ldots \alpha_k$ is specified for each group, the activation and deactivation time $$\left(t_{ein_{jp_j}}, t_{aus_{jp_j}}\right)$$

of the impulse for every LED of every single group is determined depending on the reference time $\alpha_j=\alpha_1 \ldots \alpha_k$, the control and/or regulating system (1) actuates the controllable switching elements for the determined activation time and the determined deactivation time $$\left(t_{ein_{jp_j}}, t_{aus_{jp_j}}\right)$$

of the impulse for each LED of every single group for closing or opening.

Likewise, the procedure for operating a second variant of the circuit arrangement features at least the following steps: a mean value $M_{PW}$ of all pulse widths $PW_i$ is calculated in accordance with the equation $$M_{PW} = \frac{1}{n}\sum_{i=0}^{n} PW_i.$$

Depending on the mean value $M_{PW}$ a number of k groups is specified in accordance with the equation $k=M_{PW}^{-1}$, each LED is allocated to one of the k groups.

The advantage of the present invention is that with an increasing number of groups the maximum current within an LED field is clearly reduced and becomes more constant. As the number of groups cannot be sensibly increased infinitely, the present invention likewise provides a possibility of achieving an expedient balancing of effort and benefits.

BRIEF DESCRIPTION OF THE DRAWINGS

Reference is now made more particularly to the drawings, which illustrate the best presently known mode of carrying out the invention and wherein similar reference characters indicate the same parts throughout the views

DETAILED DESCRIPTION OF THE INVENTION

Figure 1:
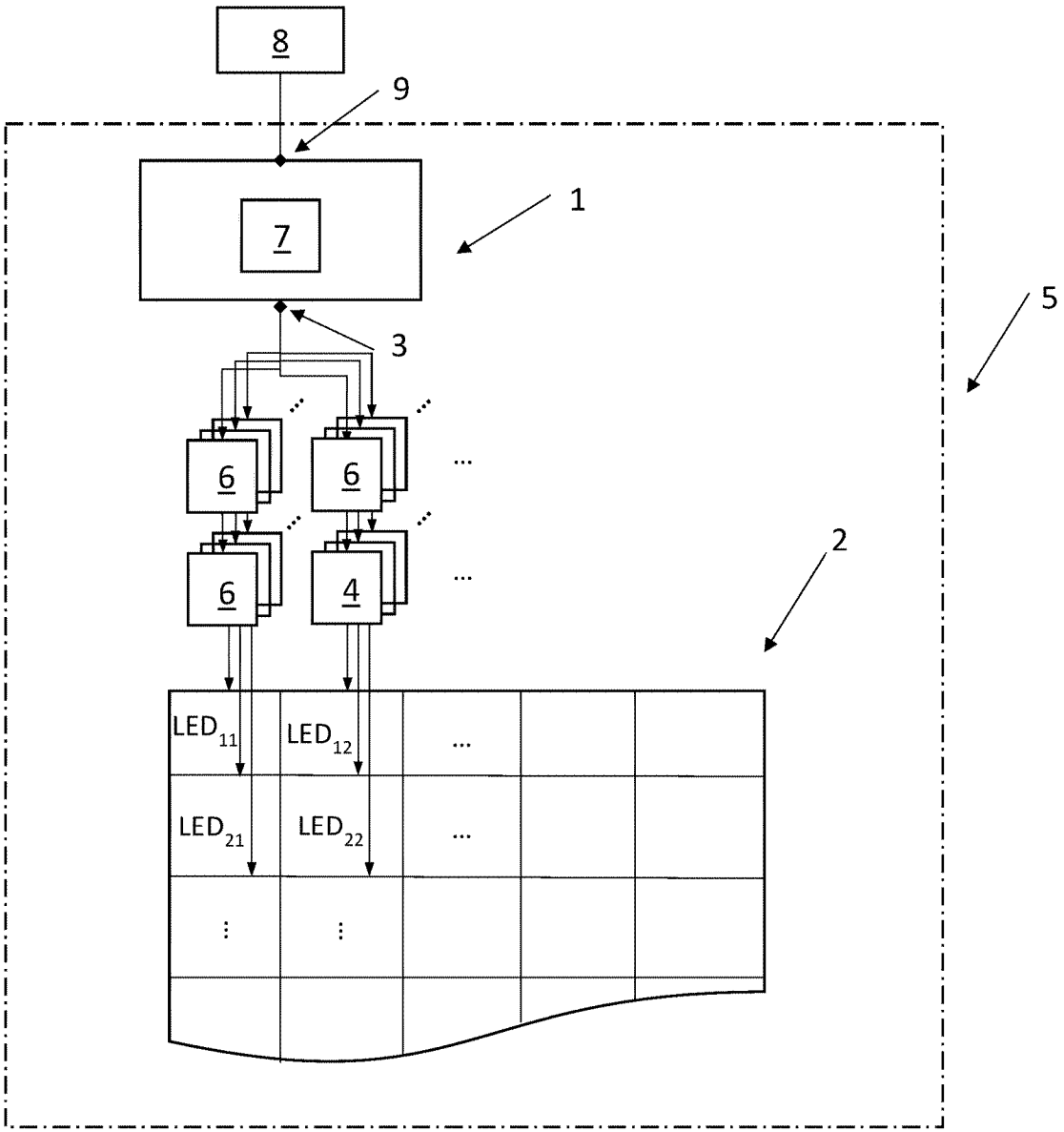
FIG. 1 is a block circuit diagram of the inventive circuit arrangement for controlling and/or regulating an LED field.

FIG. 1 shows a block circuit diagram of an inventive circuit arrangement 5 for controlling and/or regulating an LED field 2.

The inventive circuit arrangement 5 can, as an example, be realized by means of an integrated circuit, specifically a commodity chip or an ASIC. Other embodiments of the circuit arrangement 5 are entirely conceivable.

Here, the LED field 2 is assumed to be a matrix LED system as used in newly developed vehicle headlamps.

The individual LEDs $LED_{11}$, $LED_{12}$, . . . are arranged in rows and columns relative to each other. The invention is, however, not limited to LED fields with LEDs arranged in rows and columns. In this context, it is easily conceivable that the LED field 2 can feature a different arrangement of the LEDs $LED_{11}$, $LED_{12}$, . . . .

LED systems with 15,000-25,000 LEDs $LED_{11}$, $LED_{12}$, . . . are deployed in the headlamps available today.

The individual LEDs can be operated through a controllable switching element 4 that is actuated for opening or closing. The duration of the closed controllable switching element 4 sets the luminance of the individual LEDs $LED_{11}$, $LED_{12}$, . . . .

The required luminance of the individual LEDs $LED_{11}$, $LED_{12}$, . . . can be determined on the basis of image data that can be transferred to the control and/or regulating system 1 by a control unit 8.

It is likewise conceivable that the required luminance values are transferred directly to the control and/or regulating system 1.

Activation and deactivation of the controllable switching elements 4 is performed at such a high frequency that it cannot be seen by the human eye.

In addition to the LED field 2, the inventive circuit arrangement 5 comprises at least one current source 6. The current source 6 is a controllable current source 6.

It is conceivable for the inventive circuit arrangement 5 to feature a current source 6 and a controllable switching element 4 for each LED $LED_{11}$, $LED_{12}$, . . . in the LED field 2. Such an embodiment is possible, for example, with the innovative headlamps described at the beginning of the document.

Furthermore, an inventive circuit arrangement 5 specifies at least one inventive control and/or regulating system 1. The control and/or regulating system 1 preferentially has several outputs 3. Through these outputs 3, the control and/or regulating system 1 is connected with the controllable current source 6 and the controllable switching elements 4 of the LED field 1.

Likewise the control and/or regulating system can feature at least one input 9. This input can be used, for example, to transfer image data to determine the required luminance.

The inventive control and/or regulating system 1 is set up in such a way that the required process steps for achieving a desired luminance distribution of the LEDs $LED_{11}$, $LED_{12}$, . . . of the LED field 2 can be run through autonomously.

With the inventive control and/or regulating system 1, this is achieved by initially determining a number of k groups and allocating each LED to one of the k groups.

Determining the number of groups required can firstly be achieved by performing a calculation within the control and/or regulating system 1 during operation.

Furthermore, it is conceivable to determine a number of groups in advance and transfer the same to the control and/or regulating system 1.

Within the control and/or regulating system 1, provision is still made for there to be a unit 7 for determining the reference times $\alpha_j=\alpha_1 \ldots \alpha_k$.

The reference times $\alpha_j=\alpha_1 \ldots \alpha_k$ can be determined in different ways. If the computing power is to be kept to a minimum, the values can, for example, be selected at random by means of a random number generator.

The unit 7 is preferentially set up in such a way that it calculates the reference time $\alpha_j=\alpha_1 \ldots \alpha_k$ from the determined value of the number of groups.

In the inventive circuit arrangement, the unit 7 is set up in such a way that it determines the reference time $\alpha_j=\alpha_1 \ldots \alpha_k$ taking account of the number of groups as follows:

k=1: $\alpha_1$ can be chosen at will, k=2: $\alpha_1=0$, $\alpha_2=T$, $$k > 2:\ a_1 = 0,\ a_2 \ldots a_{k-1} = i\frac{T}{k-1},\ a_k = T$$

with i=1 . . . k−2, where T is a clock cycle.

Depending on the reference times then available $\alpha_j=\alpha_1 \ldots \alpha_k$ the inventive control and/or regulating system 1 can determine the activation and deactivation time $$\left(t_{ein_{jp_j}},\ t_{aus_{jp_j}}\right)$$

of the impulse for each LED in a group.

For this purpose, an equation for calculating the activation time and the deactivation time $$\left(t_{ein_{jp_j}},\ t_{aus_{jp_j}}\right)$$

of the impulse for each LED in a group is stored in the unit 7. In the present case, the following equations are made available to the unit:

$$\text{Activation time } \left(t_{ein_{jp_j}}\right):\ t_{ein_{jp_j}} = a_j - a_j * PW_{jp_j}$$

$$\text{Deactiviation time } \left(t_{aus_{jp_j}}\right):\ t_{aus_{jp_j}} = a_j + (T - a_j) * PW_{jp_j}.$$

The controllable switching elements 4 for closing or opening are actuated on the basis of the determined activation or deactivation times $$\left(t_{ein_{jp_j}},\ t_{aus_{jp_j}}\right).$$

While the controllable switching element is closed, the adjustable current source supplies the required current i to light up the selected LED and to achieve the required luminance distribution.

Figure 2A:
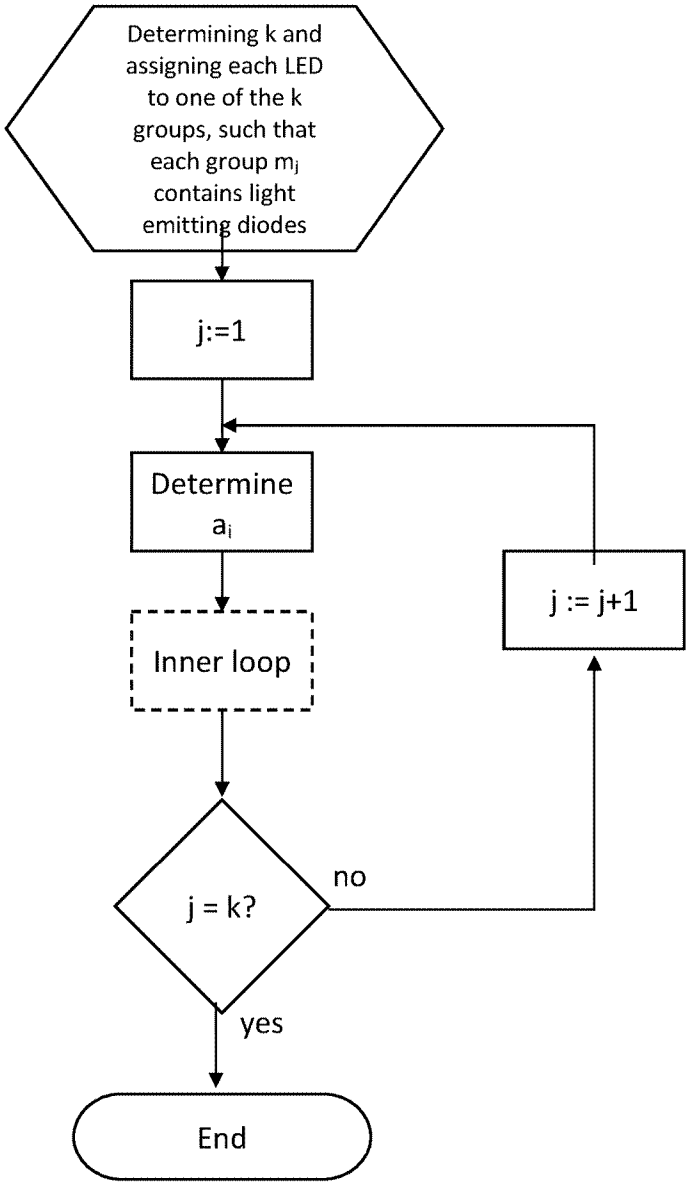
FIG. 2*a* and FIG. 2*b* show flow diagrams to demonstrate how the reference times and the activation and deactivation times are determined.
Figure 2B:
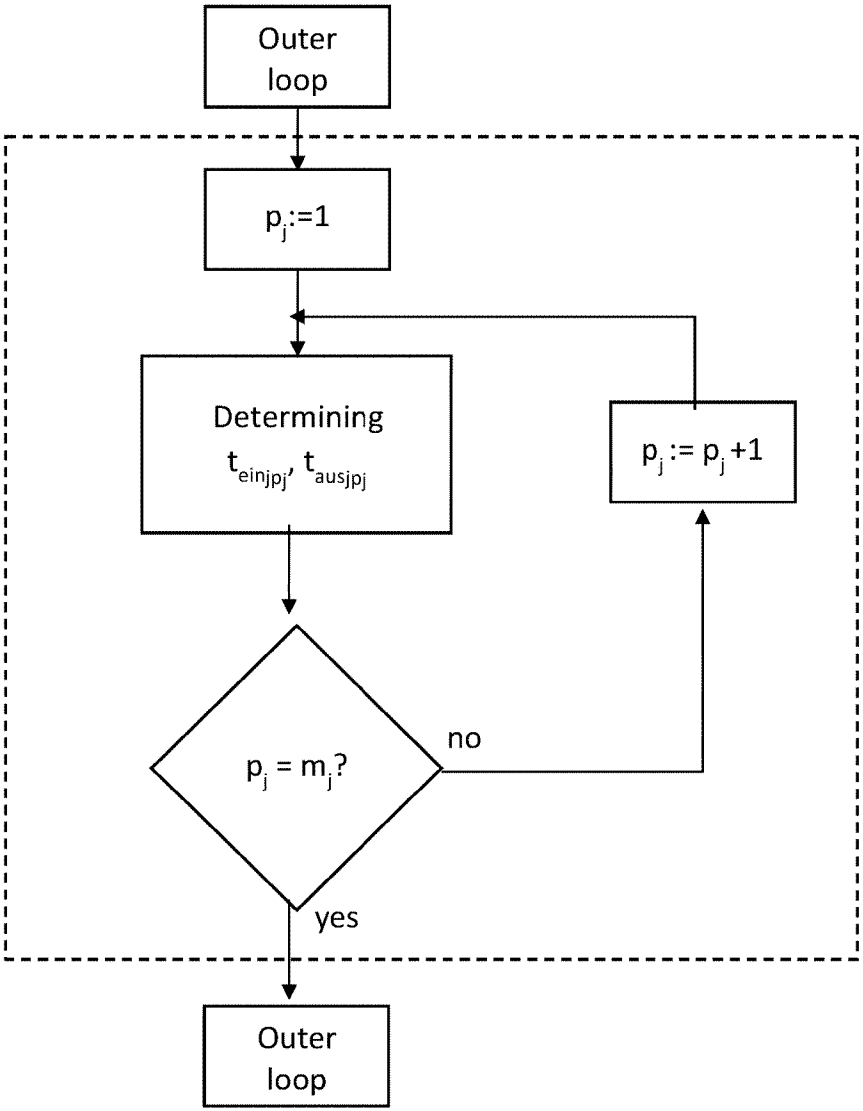

FIG. 2*a*, 2*b* show flow diagrams to better demonstrate how the reference times and the activation and deactivation times are determined. FIG. 2*a* shows an outer loop and FIG. 2*b* shows an inner loop.

As a preparatory measure, the number of k groups is determined in accordance with one of the variants described in FIG. 1 and every LED is allocated to a group such that every group contains $m_j$ LEDs. This data is fed into the system in a suitable manner.

The flow diagram begins in an outer loop in which the individual groups are run through one after the other. The value of j consequently runs from j=1 to j=k.

To begin with, j:=1 is firstly set, i.e. the first of the k groups is considered.

In a first step, one of the presented procedures is now used to determine the reference time $a_1$ for the first group. This can take place at random, for example as already shown above, in accordance with a stored table or by applying the equations presented.

After determining the reference time for the group just considered, the inner loop starts the application.

In the inner loop, the activation time and the deactivation time is determined on a recursive basis for every allocated LED $p_j$ of the group considered in this run.

The value of $p_j$ runs through all values until the number of LEDs in the respective group $m_j$ has been reached.

Initially, j=1 so that the LEDs $p_1$ of the first group are run through.

For this purpose, $p_1$:=1 is set, i.e. the first LED of the first group is considered.

Starting with the reference value for the first group, an activation time and a deactivation time are subsequently determined for this LED. Once this has happened, the next step is to perform a check as to whether the value of $p_j$ corresponds to the value of $m_j$, i.e. whether the inner loop has been worked through for all LEDs in the group considered.

If the answer to the inquiry is "no", the value of $p_j$ is increased by 1 and the inner loop run through again.

If the answer to the inquiry is "yes", the inner loop ends and the process returns to the outer loop.

Here a check is performed as to whether the value of j corresponds to the value of k and thus all groups have been worked through.

If the answer to the inquiry is "no", the value of j is increased by 1, which means the next group is considered. The recursion begins anew.

If the answer to the inquiry is "yes", all necessary calculations have been performed. The process ends.

Figure 3:
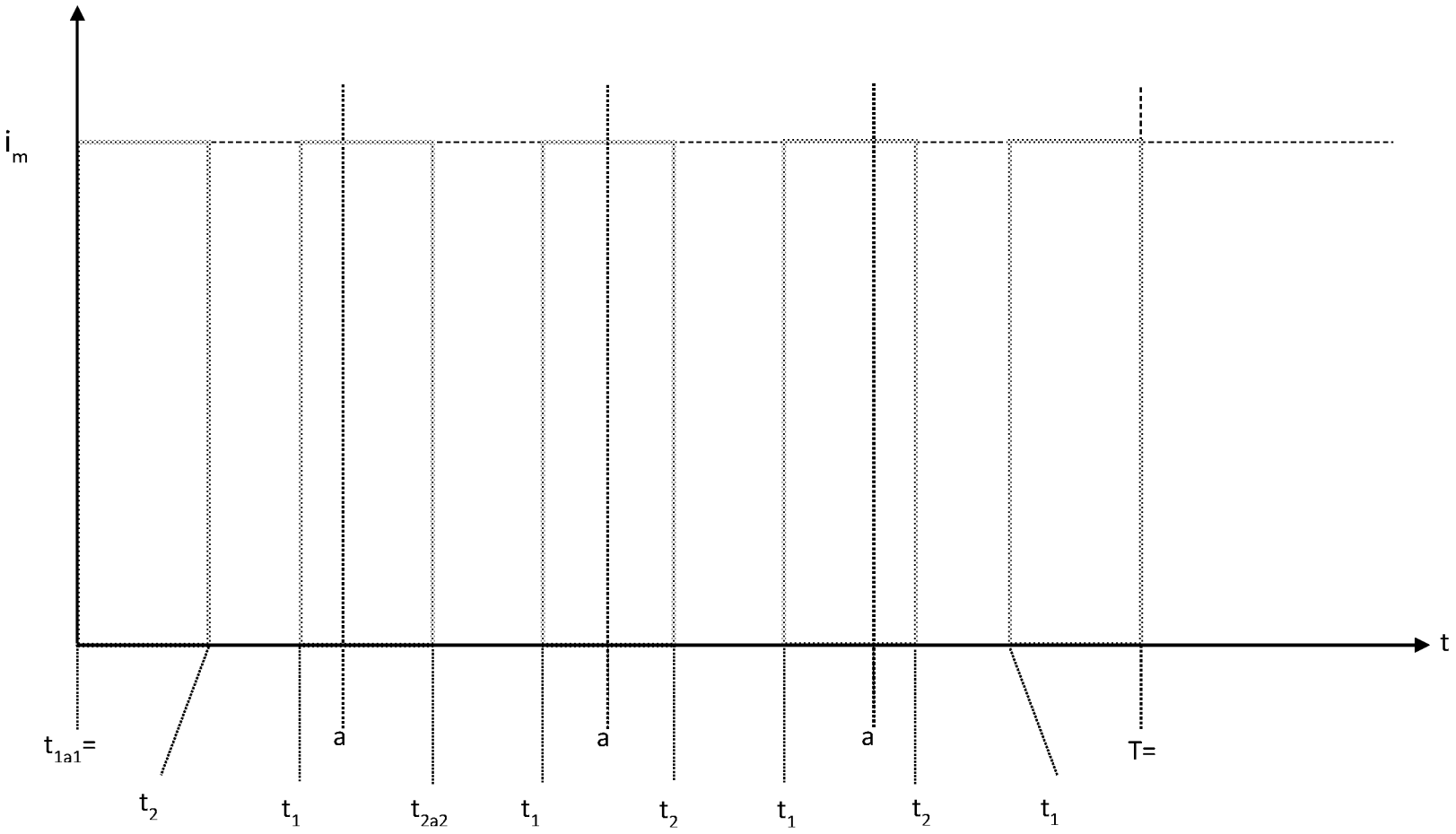
FIG. 3 is a sample representation of in inventive impulse distribution for k=5.

FIG. 3 shows a sample representation of an impulse distribution for k=5 determined in accordance with the invention.

The x-axis shows time, in this case a clock cycle T.

The y-axis shows the current of the adjustable current source 6.

When activated, the current flows $i=i_{max}$, when deactivated the status is i=0.

The calculation method shown for $\alpha_j=\alpha_1 \ldots \alpha_5$ gives rise to the reference times on the basis of the calculation model explained in FIG. 1

$$a_1 = 0,\ a_2 = \frac{T}{4},\ a_3 = \frac{T}{2},\ a_4 = \frac{3T}{4},\ a_5 = T.$$

On the basis of these reference times, the activation time and the deactivation time $$\left(t_{ein_{jp_j}}, t_{aus_{jp_j}}\right)$$

of the impulse for every LED in every single group is determined by using the equations given in FIG. 1 for the calculation.

The present example shows an impulse for each of the 5 groups. This would mean that there would only be one LED in each group. In practice, a number of LEDs are allocated to a group. The assumption that an LED is allocated to each of the k groups serves exclusively to provide more clarity in FIG. 3.

Determining the reference times and calculating the activation time and the deactivation time in accordance with the invention achieves an even distribution of the impulses over a clock cycle.

In real life, a number of LEDs $LED_{11}$, $LED_{12}$, . . . in an LED field 2 are allocated to every group. Every one of these LEDs has one impulse for setting the desired luminance.

This means that the current required within a clock cycle is not constant at $i=i_{max}$ or $i=0$ but has to be set in the way specified by the current requirement of the activated LEDs.

The objective of the present invention is to reduce the maximum current within the circuit arrangement and to harmonize the current flow.

Figure 4:
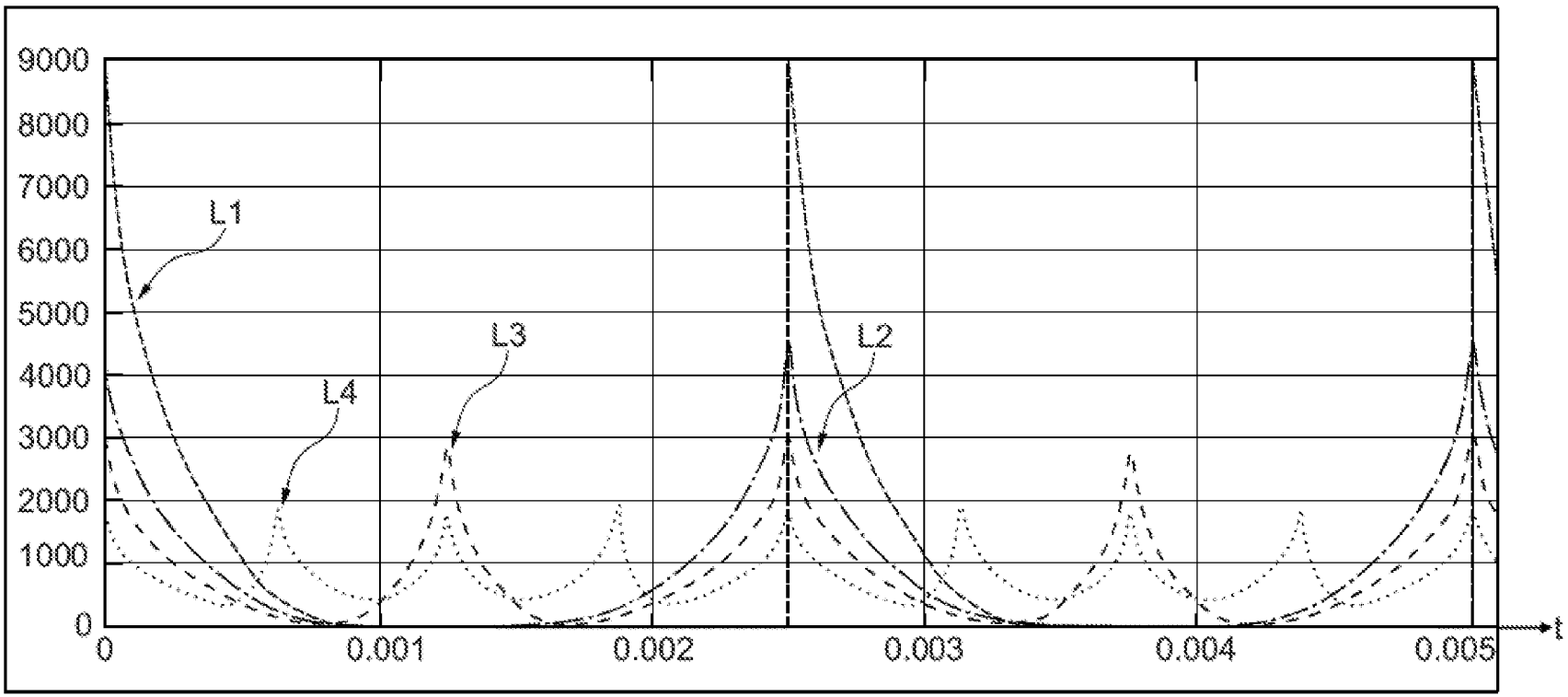
FIG. 4 shows a simulated current distribution with a different number of groups for a realistic luminance distribution.

FIG. 4 shows a simulated current distribution with a different number of groups for a realistic luminance distribution. In the present case, the number of k groups is not determined but a comparison of different numbers is performed in order to illustrate the influence of the number of groups k on the current distribution.

The activation times and deactivation times are calculated using the equations described in FIG. 1.

The simulation is a realistic arrangement with several thousand LEDs that are allocated to the different groups according to the criteria shown in FIG. 1.

Here,

L1 shows the current flow for k=1 if all LEDs are activated at $\alpha_1=0$,

L2 shows the current flow for k=2, where $\alpha_1=0$, $\alpha_2=T$ is assumed,

L3 shows the current flow for k=3, where $\alpha_1=0$, $$a_2 = \frac{T}{2},$$

$a_3=T$ is assumed,

L4 shows the current flow for k=5, where $\alpha_1=0$, $$a_2 = \frac{T}{4}, a_3 = \frac{T}{2}, a_4 = \frac{3T}{4},$$

$\alpha_5=T$ is assumed.

Current $i_{max}$ was assumed to be dimensionless with $i_{max}=1$.

As a result, it can be seen here that the maximum current is clearly reduced with an increasing number of groups and the current flow is flattened and becomes more constant. The reduction in the maximum current becomes smaller, however, with an increasing number of k, which underlines the importance of determining, as shown, the required number of groups. Prior to implementation, a balancing of effort and benefits in particular must be performed here with the help of the present invention.

LIST OF REFERENCE NUMBERS

1 Control and/or regulating system
2 LED field
3 Outputs
4 Controllable switching elements
5 Circuit arrangement
6 Current source
7 Unit for determining the reference times
8 Control unit
9 Input
$LED_1$, $LED_{12}$, . . . LEDs $$\left(t_{ein_{jp_j}}, t_{aus_{jp_j}}\right)$$

Activation or deactivation time
$\alpha_j=\alpha_1 \ldots \alpha_k$ Reference times

The invention claimed is:

1. A control system for controlling a light emitting diode (LED) field comprising:

n LEDs, where n>2, wherein each LED is allocated to one of a number of k groups such that each of the k groups contains $m_j$ LEDS and such that $1 \leq j \leq k$ and $\Sigma_{j=1}^{k} m_j = n$;

a controllable switching element designed to be activated or deactivated via control signals from an output of the control system;

the control system is configured to:

determine a reference time $\alpha_j=\alpha_1 \ldots \alpha_k$ for each of the k groups;

define activation times or deactivation times $$\left(t_{ein_{jp_j}}, t_{aus_{jp_j}}\right)$$

or impulses tor each LED through the-control signals;

send the control signals to the controllable switching element via an output of the control system;

actuate the controllable switching element during the determined impulses for closing or opening, such that closing the controllable switching element activates each LED; and wherein the activation and deactivation time $$\left(t_{ein_{jp_j}}, t_{aus_{jp_j}}\right)$$

of the impulse for each LED of each k group is based on the reference time $\alpha_j=\alpha_1 \ldots \alpha_k$ such that $1 \leq p_j \leq m_j$.

2. The control system in accordance with claim 1, wherein each LED is allocated to one of the number of k groups such that neighboring LEDs are allocated to different k groups.

3. The control system in accordance with claim 1, wherein the control system is configured to determine the reference times $\alpha_j=\alpha_1 \ldots \alpha_k$ at random.

4. The control system in accordance with claim 1, wherein the control system is configured to determine the reference times $\alpha_j=\alpha_1 \ldots \alpha_k$ as follows:

k=1: $\alpha_1$ can be chosen at will, k=2: $\alpha_1=0$, $\alpha_2=T$, $$k > 2: a_1 = 0, a_2 \ldots a_{k-1} = i\frac{T}{k-1}, a_k = T$$

with i=1 . . . k−2, where T is a clock cycle.

5. The control system in accordance with claim 1, wherein the activation time $$\left(t_{ein_{jp_j}}\right)$$

of the impulse for each LED in a group is a factor of a using an equation:

$$t_{ein_{jp_j}} = a_j - a_j * PW_{jp_j}$$

where:

$\alpha_j=\alpha_1 \ldots \alpha_k$ applies, and $PW_{jp_j}$=a pulse width of the p. LED in j. group in % of T applies, where T is a clock cycle.

6. The control system in accordance with claim 1, wherein the deactivation time $$\left(t_{aus_{jp_j}}\right)$$

of the impulse for each LED in a group is a factor of a using an equation:

$$t_{aus_{jp_j}} = a_j + (T - a_j) * Pw_{jp_j}$$

where:

$\alpha_j=\alpha_1 \ldots \alpha_k$ applies, and $PW_{jp_j}$=a pulse width of the p. LED in j. group in % of T applies, where T is a clock cycle.

7. The control system in accordance with of claim 1, wherein the control system is further configured to:

calculate $M_{PW}$, such that $M_{PW}$ is a mean value of all pulse widths $PW_i$ of the LED field in accordance with an equation $$M_{PW} = \frac{1}{n}\sum_{i=0}^{n} PW_i,$$

wherein, the number of k groups is based on the mean value $M_{PW}$ in accordance with an equation $k=M_{PW}^{-1}$, and wherein each LED is allocated to one of the number of k groups.

8. The control system according to claim 1 further comprising:

a current source for each LED, where the LED field comprises at least two series circuits each of which comprises at least one LED and a controllable switching element, where a control connection of each controllable switching element is connected with an output of the control system.

9. The control system in accordance with claim 8, wherein each current of the current source can be regulated by the control system, where the current with a closed controllable switching element is $i=i_{max}$ and with an opened controllable switching element is i=0.

10. A method for programming a control system comprising:

reproducing, in a simulation, required luminance distributions that are to be achieved with a light emitting diode (LED) field, determining, by means of the simulation, the impulses of the individual LEDs in a k group for the required luminance distribution, wherein each LED is allocated to one of a number of k groups such that the LEDs allocated to a particular k group are controlled together, such that each of the k groups contains $m_j$ LEDs, and that $1 \le j \le k$ and $\Sigma_{j=1}^{k} m_j = n$, simulating a current distribution in the LED field for different numbers of k groups on the basis of the impulses, determining an optimum number of k groups on the basis of the current distributions, transferring the data determined on the basis of the simulation to the control system.

11. A method for operating a circuit arrangement comprising:

determining, by a control system, a number of k groups, allocating a plurality of light emitting diodes (LEDs), each to one of the number of k groups, specifying a reference time $\alpha_j=\alpha_1 \ldots \alpha_k$ for each one of the number of k groups, such that each of the k groups contains $m_j$ LEDs, and that $1 \le j \le k$ and $\Sigma_{j=1}^{k} m_j = n$, determining activation and deactivation time $$\left(t_{ein_{jp_j}}, t_{aus_{jp_j}}\right)$$

of the impulse for each LED of each one of the number of k groups based on the reference time $\alpha_j=\alpha_1 \ldots \alpha_k$, controlling, by the control system, controllable switching elements for the determined activation time and the determined deactivation time $$\left(t_{ein_{jp_j}}, t_{aus_{jp_j}}\right)$$

of the impulse for each LED of each one of the number of k groups for closing or opening the controllable switching elements, wherein the LEDs allocated to a particular k group are controlled together.

12. The method of claim 11 further comprising:

calculating a mean value $M_{PW}$ of all pulse widths $PW_i$ of the LED field in accordance with an equation $$M_{PW} = \frac{1}{n}\sum_{i=0}^{n} PW_i;$$

and determining the number of k groups based on the mean value $M_{PW}$ in accordance with the equation $k=M_{PW}^{-1}$, and allocating each of the plurality of LEDs to one of the number of k groups.

* * * * *